US006102008A

United States Patent [19]

Maeda et al.

[11] Patent Number: 6,102,008

[45] Date of Patent: Aug. 15, 2000

[54] FUEL INJECTION VALVE CONTROLLER APPARATUS

[75] Inventors: Susumu Maeda, Saitama; Kazuya Yokayama, Tochigi, both of Japan

[73] Assignee: Honda Giken Kogyo Kabushiki Kaisha, Tokyo, Japan

[21] Appl. No.: 09/021,168

[22] Filed: Feb. 10, 1998

[30] Foreign Application Priority Data

Feb. 14, 1997 [JP] Japan ..... 9-047159

[51] Int. Cl.[7] ..... F02M 51/00

[52] U.S. Cl. ..... 123/490; 361/154

[58] Field of Search ..... 123/490, 494; 361/152, 154, 187

[56] References Cited

U.S. PATENT DOCUMENTS 4,417,201 11/1983 Reddy ..... 123/490
4,715,353 12/1987 Koike et al. ..... 123/490
5,053,911 10/1991 Kopec et al. ..... 361/154
5,341,032 8/1994 Brambilla et al. ..... 361/187
5,687,050 11/1997 Bartsch ..... 123/490

FOREIGN PATENT DOCUMENTS 58-211538 12/1983 Japan .
62-4543 1/1987 Japan .

*Primary Examiner*—Erick R. Solis
*Attorney, Agent, or Firm*—Arent, Fox, Kintner, Plotkin & Kahn

[57] ABSTRACT

The fuel injection valve controller steadily detects the completion of opening of the fuel injection valve or the completion of the needle valve lifting movement. A current flowing through the electromagnetic coil 4 which drives the fuel infection valve, is measured based on the voltage difference V across the resistor R6 connected in series with the coil 4. The circuit 21 emphasizes changes in the coil current. The signal V2 representative of emphasized coil current is supplied to the current change detecting circuit 22 which generates the output signal V3 when the coil current or voltage signal V2 temporarily decreases. The signal V3 is compared with the reference voltage Vref to issue the signal S3 showing the full opening of the fuel injection valve.

10 Claims, 6 Drawing Sheets

FUEL INJECTION VALVE CONTROLLER APPARATUS

BACKGROUND OF THE INVENTION

Field of the Invention

The present invention relates to a fuel injection valve controller apparatus for use in a combustion engine and particularly, to a fuel injection valve controller apparatus suited to steadily detect the completion of opening of the fuel injection valve or the completion of the needle valve lifting movement.

FIG. 7 is a longitudinal cross sectional view showing a conventional electromagnetic fuel injection valve (referred to as an "injection valve" hereinafter). A hollow sleeve 2 made of a magnetic material is fitted into a cylindrical housing 1 made of a similar magnetic material. The hollow sleeve 2 includes a stationary core 2*a*, a flange 2*b*, and a fuel inlet member 2*c*. A bobbin 3 and an electromagnetic coil 4 (referred to as a "coil" hereinafter) wound on the bobbin 3 are disposed in a space between the housing 1 and the stationary core 2*a* so that it surrounds the stationary core 2*a*. The stationary core 2*a* has a compression coil spring 5 therein for urging a plunger (movable core) 6, which is located opposite to one end of the hollow sleeve 2, in a direction to close the injection valve.

A valve seat 8 is provided in the tip of the housing 1, which slidably accommodates a needle valve 7 coupled to the movable core 6.

The valve seat 8 is covered with a nozzle 9 and swagelocked together with the nozzle 9 to one (front) opening end of the housing 1. The flange 2*b* of the hollow sleeve 2 is also swagelocked to the other or rear opening end of the housing 1. The flange 2*b* is fixedly joined at top with a connector 10 made of an insulating material such as resin. The connector 10 has a terminal 10*a* therein electrically connected to the coil 4. The fuel inlet member 2*c* of the hollow sleeve 2 accommodates a strainer 12 which includes a filter net 11 therein. A fuel is admitted through the hollow sleeve 2 as shown by the arrow A and flown to a space between the valve seat 8 and the needle valve 7.

In operation, energizing of the coil 4 through the terminal 10*a* causes the movable core 6 to be attracted toward the hollow sleeve 2 and the needle valve 7 to depart from the valve seat 8 as resisting against the yielding force of the compression coil spring 5. Accordingly, the fuel is ejected out from an injection aperture 13 provided in the front end of the valve seat 8. The energizing of the coil 4 or the injection of the fuel can be controlled depending on an operating condition of the engine.

For improving the response of the injection valve to the operating condition of the engine or making the injection valve compatible with injection of a large amount of fuel such as in a direct injection engine or a gaseous fuel internal combustion engine, it is essential to supply the coil 4 with a large quantity of electric current and thus increase the magnetic attraction of the stationary core 2*a* for valve opening. However, if such a higher current were fed throughout the energizing period, the temperature of the coil 4 may radically increase and extra scheme for radiating heat from relevant switching elements (or drivers) in a drive circuit for energizing the coil 4 will be needed and it will be rather difficult to realize in the industrial field.

For a countermeasure thereof, the coil current is provided of a higher intensity at the starting of valve opening and it is reduced to the level of maintaining the valve opening after completion of the valve opening (when the needle valve has been lifted up).

It is known that the coil current in the injection valve is varied depending on a change (increase) of the inductance due to the position of the movable core, that is, the coil current decreases as the needle valve is fully lifted up (as for example disclosed in Japanese Patent Publication No. SHO 62-4543). For example, a controller apparatus disclosed in Japanese Patent Laid-open Publication No. SHO 58-211538 provides detecting the completion of valve opening from a drop of the coil current corresponding to the end of lifting operation and then decreasing the coil current.

The following disadvantage exist in such a conventional controller apparatus capable of reducing the coil current, after the coil current reaches at a specific or singular point, to a minimum level enough to hold the valve opening. The conventional controller apparatus allows the specific point to be recognized by detecting a point where a variation in the coil current is shifted again from negative to positive after it has once turned from positive to negative. However, this means may find it difficult to detect the specific point in some cases. For example, the shift of the coil current from positive to negative is attenuated by change in the source voltage for supply of the coil current, change in the coil temperature, and/or change in the pressure of fuel injection and, therefore, the shift back to positive from negative will thus be recognized with much difficulty. Accordingly, the stable detection of the specific point can hardly be consistent resulting in unstable control over the coil current.

SUMMARY OF THE INVENTION

It is an object of the present invention to provide a fuel injection valve controller apparatus capable of performing stable current control through steadily detecting the completion of lifting movement mentioned above.

A fuel injection valve controller apparatus, according to the present invention, supplies an electromagnetic coil with a current to open a fuel injection valve of an internal combustion engine, and is characterized in comprising a current detecting means for detecting the current flowing through the electromagnetic coil, a current change detecting means for detecting decrease of the current on the basis of an output of the current detecting means during opening of the fuel injection valve a current change emphasizing means connected between an output terminal of the current detecting means and a positive input terminal of the current change detecting means, in order to recognize that the fuel injection valve is fully opened.

The current change detecting means is provided between an output terminal of the current detecting means and an input terminal of the current change detecting means, and comprises an operational amplifying means having a first input terminal connected to the output terminal of the current detecting means and a second input terminal connected to an output terminal thereof via a feedback path which includes a delay means and a determining means for generating a current change detection signal through comparing between an output signal of the operational amplifying means and a reference setting.

The current change emphasizing means comprises a second operational amplifying means having a first input terminal connected to the output terminal of the current detecting means and a second input terminal connected to an output terminal thereof via a second feedback path which includes a second delay means and a filter means connected to the output terminal of the second operational amplifying means for removing a high frequency component from an output signal of the second operational amplifying means, in which an output signal of the filter means is fed to the first input terminal of the current change detecting means.

DETAILED DESCRIPTION OF THE PREFERRED EMBODIMENT

Figure 1:
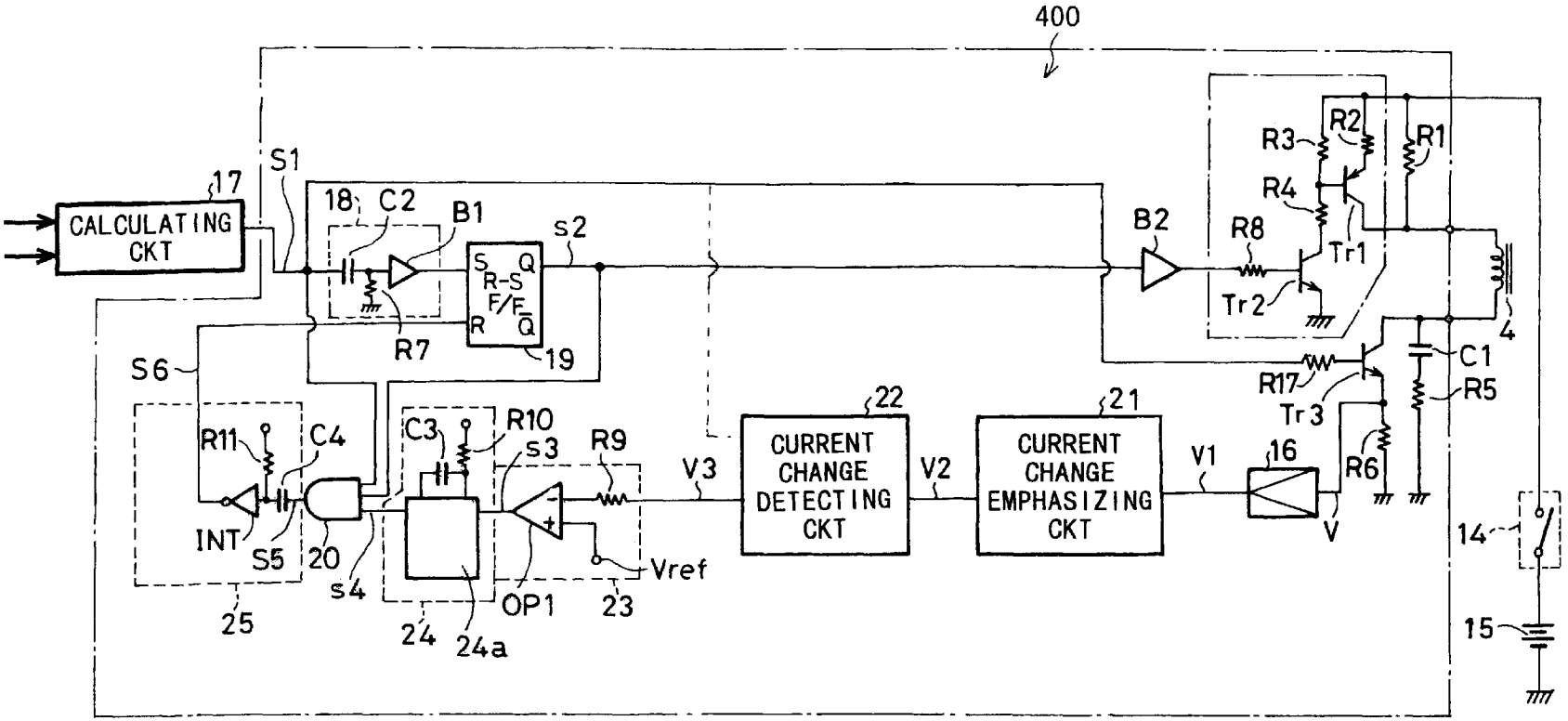
FIG. 1 is a circuit diagram of a controller apparatus showing one embodiment of the present invention.
Figure 7:
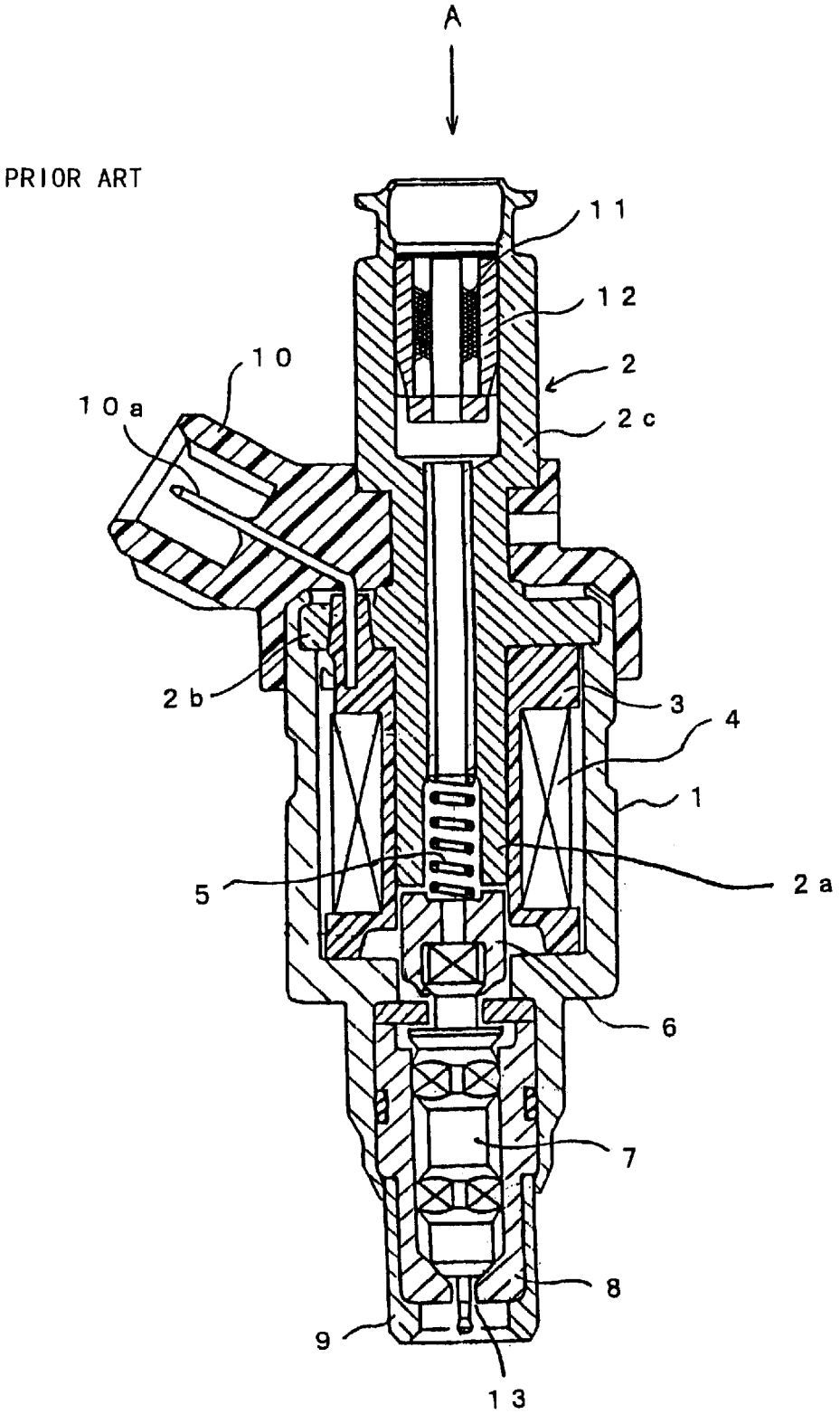
FIG. 7 is a cross sectional view showing a typical fuel injection valve.

The present invention will be described in more details referring to the accompanying drawings. FIG. 1 is a block diagram showing a fuel injection valve controller apparatus according to the embodiment of the present invention. It is assumed that controller is equipped with the fuel injection valve shown in FIG. 7 and the following description refers to also FIG. 7.

The drive controller 400 is now explained in more detail referring to FIG. 1. As shown, a high potential end of the coil 4 for driving the fuel injection valve is connected via a resistor R1 and an ignition switch 14 to the positive terminal of a battery 15. A transistor Tr1 having an emitter resistor R2 is connected in parallel to the resistor R1. The base of the transistor Tr1 is connected to one ends of two resistors R3 and R4 respectively. The other end of the resistor R3 is connected to the resistor R2, while the other end of the resistor R4 is connected to the collector of the transistor Tr2 of which emitter is grounded.

The lower potential end of the coil 4 is connected to the collector of the transistor Tr3. The transistor Tr3 is connected in parallel with a combination of the a capacitor C1 and a resistor R5 coupled in series to each other. The emitter of the transistor Tr3 is connected to a resistor R6 which serves as a current detecting means and delivers a potential signal V indicative of the coil current to the input of an amplifier circuit 16.

The calculating circuit 17 decides a valve opening time period for a optimum air-fuel ratio on the basis of the operating condition of the engine and provides the signal S1 having a pulse width corresponding to the valve opening period. The output signal S1 is fed to a trigger circuit 18 which comprises a capacitor C2, a resistor R7, and a buffer B1. The output of the trigger circuit 18 is connected to the set terminal of an RS flip-flop 19. The Q output S2 of the flip-flop 19 is connected to the base of the transistor Tr2 via a buffer B2 and a resistor R8 coupled in series to each other. The output signal S1 is also fed to an AND gate 20. In addition, the AND gate 20 receives the Q output S2 from the flip-flop 19.

An output voltage V1 from the amplifier circuit 16 is fed to a current change emphasizing circuit 21 from which an output signal V2 is transmitted to a current change detecting circuit 22. Both the current change emphasizing circuit 21 and the current change detecting circuit 22 will be described later in more detail referring to FIG. 2. An output V3 from the current change detecting circuit 22 is fed via a resistor R9 to the negative (inverse) input terminal of an operational amplifier OP1 which defines a comparator circuit 23. The positive (non-inverse) input terminal of the operational amplifier OP1 is supplied with a reference voltage Vref. The current change detecting circuit 22 and the comparator circuit 23 constitute a current change detecting means.

An output signal S3 from the operational amplifier OP1 is fed to a one-shot circuit 24 which comprises a capacitor C3, a resistor R10, and a one-shot multivibrator 24*a*. An output signal S4 from the one-shot circuit 24 is transmitted as a further input to the first AND gate 20. The one-shot multivibrator 24*a* may preferably be of non-retriggerable type such as $\mu$PD74HC123A. An output signal S5 from the AND gate 20 is fed to a trigger circuit 25 which comprises a capacitor C4, a resistor R11, and an inverter circuit INT. An output signal S6 from the trigger circuit 25 is transmitted to the reset terminal of the flip-flop 19.

Figure 2:
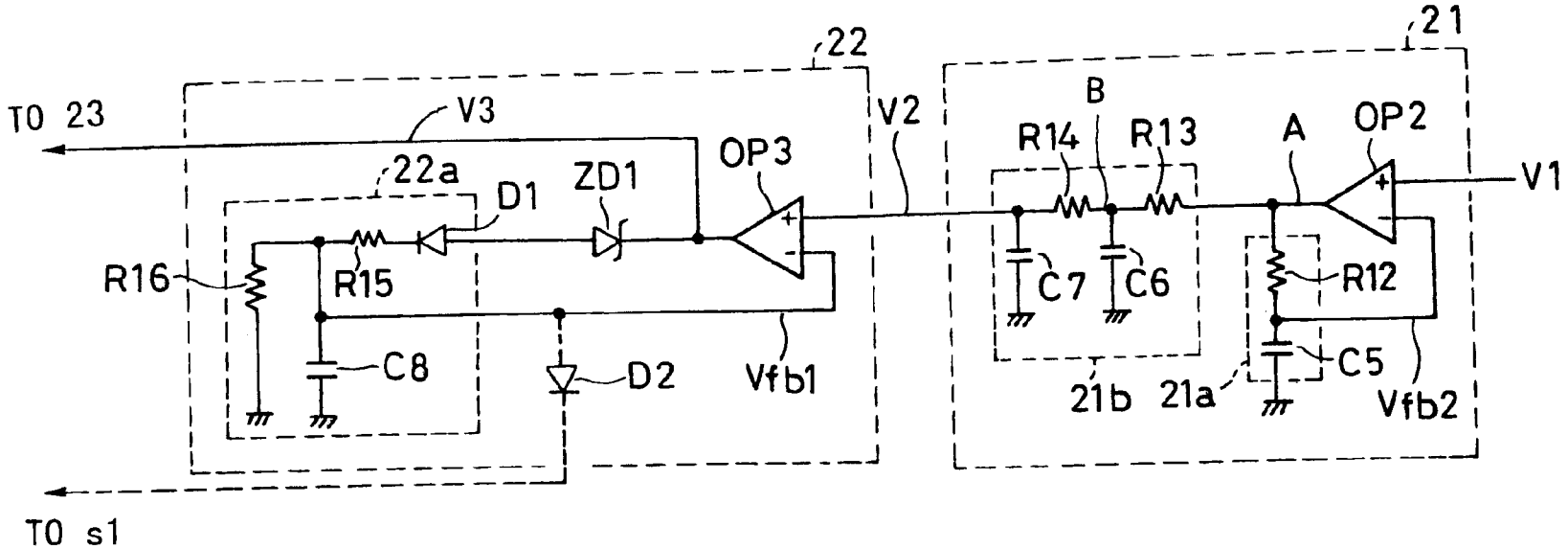
FIG. 2 is a circuit diagram of a primary part of the controller apparatus according to the embodiment of the present invention.

Referring to FIG. 2, the current change emphasizing circuit 21 and the current change detecting circuit 22 are now explained. The current change emphasizing circuit 21 has at its first stage an operational amplifier OP2 of which positive terminal is supplied with the output signal V1 from the amplifier circuit 16. The negative terminal of the operational amplifier OP2 receives a delayed negative feedback signal Vfb2 from a negative feedback delay circuit 21*a* which comprises a resistor R12 and a capacitor C5. An output A from the operational amplifier OP2 is fed to a two-stage filter 21*b* which comprises a resistor R13 (2.2 kiloohm), a resistor R14 (47 kiloohm), a capacitor C6 (0.1 microfarad), and a capacitor C7 (4700 picofarads).

An output signal V2 from the filter 21*b* is fed to the positive terminal of an operational amplifier OP3 located at the first stage of the current change detecting circuit 22. The negative terminal of the operational amplifier OP3 is supplied with a delayed negative feedback signal Vfb1 from a negative feedback delay circuit 22*a* which comprises a diode D1, resistors R15 and R16, and a capacitor C8. An output signal V3 from the operational amplifier OP3 is fed via a Zener diode ZD1 to the anode of the diode D1. The Zener diode ZD1 is a potential difference generating means for making the negative feedback delay circuit 22*a* stable with the output of the operational amplifier OP3. The Zener diode ZD1 preferably has a breakdown voltage higher than an offset voltage of the operational amplifier OP3 and more particularly, its breakdown voltage may be substantially 1 to 4 volts in relation to 12 volts of a source voltage from the battery 15. It should be noted that the Zener diode ZD1 can be eliminated since the negative feedback delay circuit 22*a* is stabilized in operation with a potential difference produced by forward voltage drop across the diode D1.

The charge time constant is determined by the resistor R15 and the capacitor C8 so that it is small enough to follow a possible positive change of the potentials V1 and V2. While, the discharge time constant is determined by the resistor R16 and the capacitor C8 so that it is greater than a possible rate in the negative change of the potentials V1 and V2.

For example, to have the charge time constant of 0.022 millisecond and the discharge time constant of 2.2 milliseconds, the resistor R15, the resistor R16, and the capacitor C8 are set to 1 kiloohm, 100 kiloohms, and 0.022 microfarad, respectively.

The output V3 of the operational amplifier OP3 is connected to a comparator circuit 23 (FIG. 1). For promoting the discharge of the capacitor C8, a diode D2 may be provided connecting the delay output of the negative feedback delay circuit 22*a* to the output line of the calculating circuit 17 as denoted by the dotted line in FIG. 2.

Figure 3:
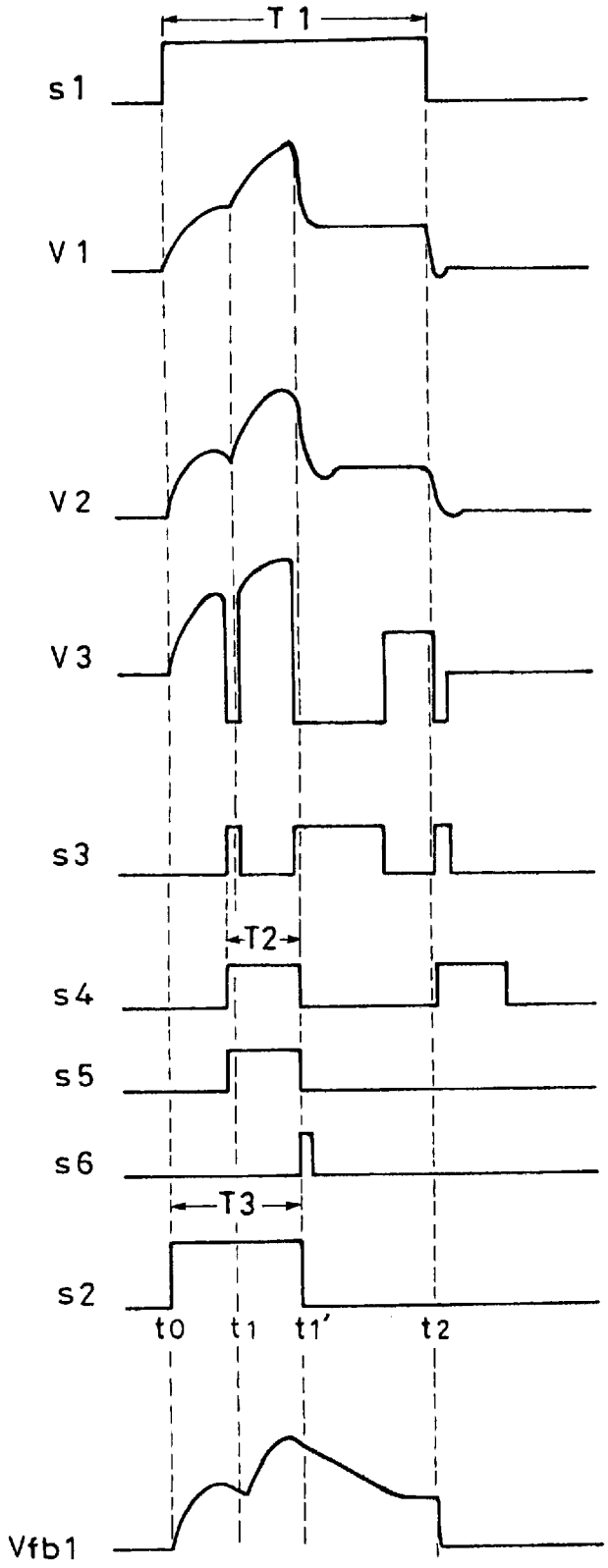
FIG. 3 is a waveform diagram showing operation of the controller apparatus.

The operation of the circuits shown in FIGS. 1 and 2 is now explained referring to the waveform diagram of FIG. 3. When the ignition switch 14 is turned on, the voltage (e.g. 12 volts) is applied from the battery 15 to the driver controller 400 (FIG. 1). In general, the ignition switch for a vehicle internal combustion engine has four contacts; LOCK (shutting off all power supply), ACC (turning on a vehicle radio, etc), ON (running the vehicle), and START (energizing a starter motor) arranged in this order. It should be noted in the present specification that when the ignition switch is turned on, it stays at either ON or START contact. When the calculating circuit 17 releases the valve opening pulse signal S1 at the time t0, the transistor Tr3 is activated. The pulse signal S1 is kept high during the valve opening period T1 determined by the calculating circuit 17. Simultaneously, the trigger circuit 18 in response to the signal S1 causes the flip-flop 19 to be set. The rise of the Q output S2 of the flip-flop 19 turns on the transistors Tr2 allowing a high intensity of current to run via the two resistors R1 and R2 connected in parallel, the transistor Tr3, and the resistor R6 to the coil 4.

The current fed to the coil 4 is detected in term of a potential drop V across the resistor R6 or the output voltage V1 of the amplifier circuit 16. When the coil 4 is energized at t0, its current increases to elevate the potential V1 as shown in FIG. 3. This causes the movable core 6 to be attracted by the stationary core 2*a* increasing the inductance of the coil 4 and thus temporarily lowering the coil current and the potential V1. As the needle valve 7 is attracted to the extream end of its stroke, the potential V1 soars again at t1. The temporarily lowering of the potential V1 means the approaching of the needle valve 7 to its stroke end. After a given period T2 required for ensuring soft stopping of the needle valve 7 has elapsed since the lowering of the potential V1 is detected, the operation is switched (at the time t1') to a hold period where the coil 4 is supplied with a low intensity of current for holding the valve opening. The switching to the low or hold current is carried out by the following procedure.

The current change emphasizing circuit 21 shapes up the waveform of the potential V1 to produce the potential V2 in which a change thereof is emphasized, as described later in more detail. The potential V2 is fed to the positive input of the operational amplifier OP3 in the current change detecting circuit 22. Since the charge time constant of the resistor R15 and the capacitor C8 are low, the delayed negative feedback signal Vfb1 of the operational amplifier OP3 is substantially equal to the potential V2 at the positive input during the change emphasized potential V2 is increasing. The operational amplifier OP3 delivers the output V3 which is higher than a sum (4 volts or more) of the breakdown voltage of the Zener diode ZD1 and the forward voltage drop of the diode D1, while its two inputs are substantially equal to each other in the amplitude level. When the reference voltage Vref of the operational amplifier OP1 in the comparator circuit 23 is set to a half (that is, 2 volts) of the breakdown voltage (4 volts in this embodiment) of the Zener diode ZD1, since the output V3 remains higher than the reference voltage Vref during the potential V1 is increasing, the output S3 of the operational amplifier OP1 stays at low level. Accordingly, the two signals S4 and S5 are kept low hence disabling the trigger circuit 25 to deliver the reset signal S6 and maintaining the high coil current mode.

When the potential V2 begins to be lowered by increase of the inductance of the coil 4 close to the time t1, the delayed negative feedback signal Vfb1 fails to follow the drop of the potential V2 due to the large discharge time constants of the resistor R16 and the capacitor C8 and whereby the potential at the negative terminal of the operational amplifier OP3 becomes higher than the input potential V2 at the positive terminal of the same. This causes the output V3 of the operational amplifier OP3 to drop down to nearly zero volt. When the output V3 is lower than the reference voltage Vref of the comparator circuit 23, the output S3 of the operational amplifier OP1 shifts to high level triggering the one-shot circuit 24 at the following stage. The output S4 of the one-shot circuit 24 is kept on during a period T2 (e.g. 0.4 to 0.5 millisecond) determined by the resistor R10 and the capacitor C3. The period T2 lasts from the lifting amount of the needle valve is finished until the needle valve becomes at rest, or the period T2 is for delaying the current change detecting signal. The signal S4 causes the AND gate 20 to open and its output S5 to stay high during the period T2. In response to the decay of the output S5, the trigger circuit 25 delivers the signal S6 to the reset input of the flip-flop 19. When the flip-flop 19 is reset by the signal S6 at the time t1', the high coil current period T3 ends up. More specifically, the decay of the signal S2 turns off the transistors Tr1 and Tr2 and disconnects the coil current flowing through the transistor Tr1 thus allowing the low current to flow through the coil 4 for the hold period.

The signal S3 also rises in a transit period close to the time t1' in FIG. 3) where the operation is switched to the low current mode and the potential V1 decreases. However, because of the non-retriggerable type one-shot multivibrator used in the one-shot circuit 24, the rising of the signal S3 will not affect the output S4.

The current change detecting circuit 22 detects a decrease in the current flowing through the coil 4 based on a legible voltage change of at least 4 volts (the sum of the breakdown voltage in ZD1 and the voltage drop in D1) to 0 volt caused by inverse of the level relation between the input V2 at the positive input of the operational amplifier OP3 and the delayed negative feedback signal Vfb1 at the negative input of the same. This can absorb any variation such as a source voltage change and an offset voltage change caused by temperature drift. The operational amplifier OP3 will neither affected by short pulse such as an ignition noise because it is less responsive to such short pulses. As described above, the current change detecting circuit 22 in the embodiment is capable of reliable detecting a decrease in the current through the coil 4.

Figure 4:
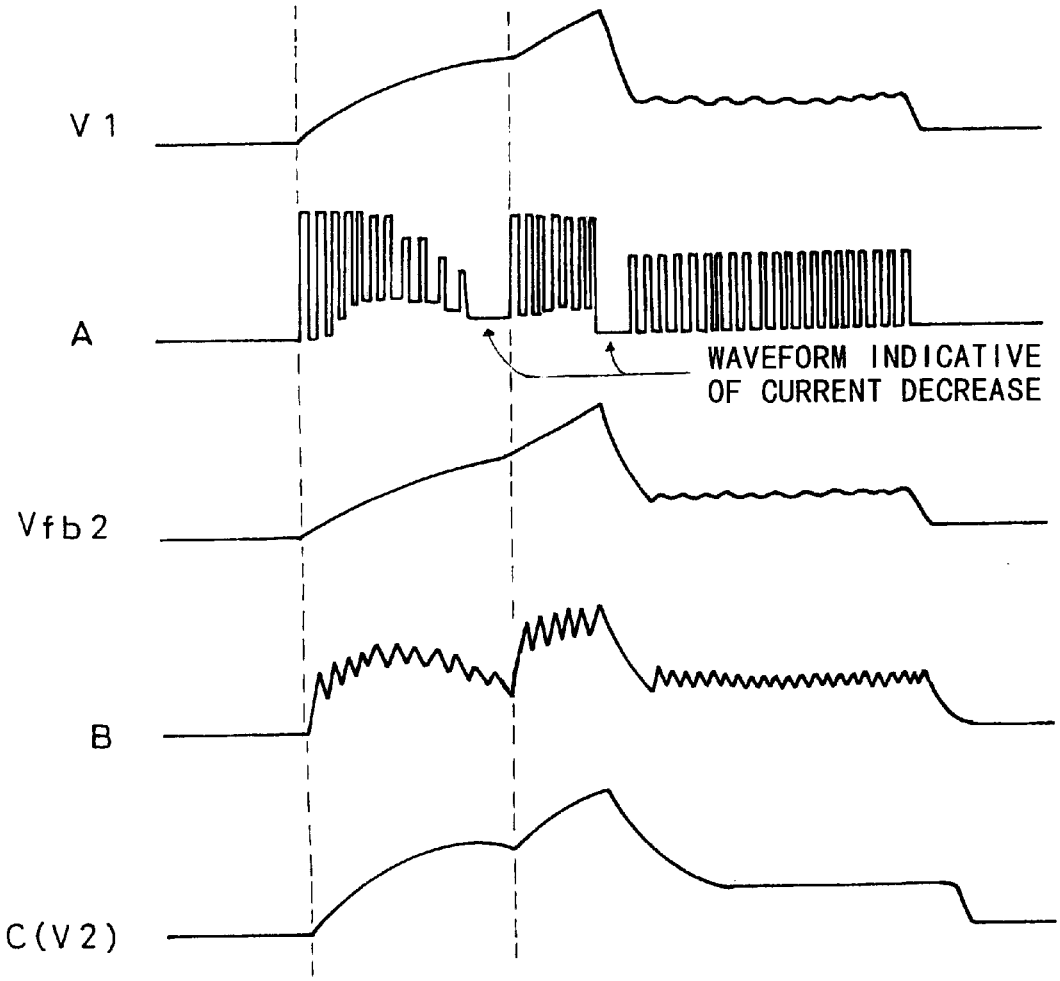
FIG. 4 is a waveform diagram showing operation of a current change emphasizing circuit.

The operation of the current change emphasizing circuit 21 is now explained referring to FIG. 2 and the waveform diagram of FIG. 4. The output A is controlled by the operational amplifier OP2 so that the potential V1 at its positive input and the delayed negative feedback signal Vfb2 at its negative input are substantially equal to each other. More specifically, when the potential V1 is higher than the delayed negative feedback signal Vfb2, the output A is increased to be higher than the potential V1. When the potential V1 is lower than the delayed negative feedback signal Vfb2, on the contrary, the output A is decreased to be lower than the existing level. Since the delayed negative feedback signal Vfb2 has a delay determined by the time constant of the resistor R12 and the capacitor C5, the operational amplifier OP2 delivers a rather oscillating version of the maximum amplitude (waveform A in FIG. 4).

As the injection valve comes close to its full opening state, the increasing change in the potential V1 or the coil current shifts to decreasing change and the potential V1 at last reaches to be equal to the delayed negative feedback signal Vfb2 which has been delayed by a certain time respective to the potential V1. Upon the potential V1 and the delayed negative feedback signal Vfb2 being equal to each other, the operational amplifier OP2 disables its output. Accordingly, the output A of the operational amplifier OP2 has a waveform indicative of the current decrease which is shown by arrows in FIG. 4.

In brief, the operational amplifier OP2 operates as follows. While the input signal V1 is increasing, the average of the output A is kept higher than the delayed negative feedback signal Vfb2. While the input signal V1 is decreasing, the average of the output A is kept lower than the delayed negative feedback signal Vfb2. By this manner, the delayed negative feedback signal Vfb2 is controlled to follow the input signal V1. Accordingly, the output V2 of a second stage filter is higher than the input V1 when the coil current is increasing while lower when it is decreasing. In addition, when the input signal V1 is stable, the output V2 is converged so that it is equal in amplitude to the input V1.

The output A of the operational amplifier OP2 is then passed to a first stage filter composed of the resistor R13 and the capacitor C6 and the second stage filter composed of the resistor R14 and the capacitor C7 where it is converted to the signal V2 in which the current change is emphasized. Consequently, the decrease of the potential V1 is converted to the emphasized decrease of the potential V2, thus providing ease of the detection in the current change detecting circuit 22. The above is the control of power supply over the current through coil 4 in the first operation mode or normal condition.

Although the driver has a two-stage construction where a high current supply and a low current supply are switched from one to the other in the embodiment, the present invention is not limited to the embodiment. The driver may have a one-stage construction in which a controller for controlling the driver is switched between two difference waveforms of the signal before further transmission.

Figure 5:
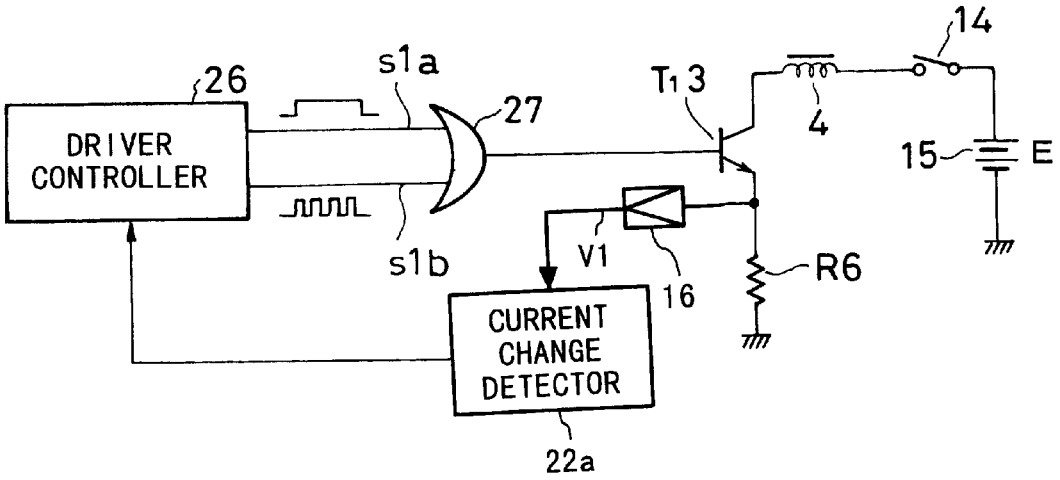
FIG. 5 is a circuit diagram showing a modification of the embodiment of the present invention.

FIG. 5 is a block diagram showing one of modifications of the embodiment. When a transistor Tr3 is turned on with an ignition switch 14 closed, a coil 4 is supplied with a coil current from a battery 15. A driver controller 26 includes a high current supply signal generating means and a limited current supply signal generating means (both are not shown). The high current supply signal generating means produces a signal s1a with 100% duty for feeding a high intensity of the coil current it the initial duration of the valve opening. The limited current supply signal generating means produces a chopping signal sib with a predetermined rate of duty (less than 100%). The signal s1a or s1b is transmitted via an OR gate 27 to the base of the transistor Tr3. The transistor Tr3 is turned on by the signal s1a or s1b, allowing the current on the coil 4 to be detected by a resistor R6.

At the initial duration, the signal s1a is selectively activated and decrease of a potential V1 which represents the coil current is detected by a current change detector 22*a*. In response to a result of the detection, the driver controller 26 switches the signal from s1a to s1b. The switching is preferably carried out after the duration T2 (FIG. 3) is elapsed. The duration T2 may be set to zero if desired. The current changed detector 22*a* is identical to those explained above with reference to FIGS. 1 and 2 and may be added with a current change emphasizing circuit 21 as shown in FIG. 2.

Figure 6:
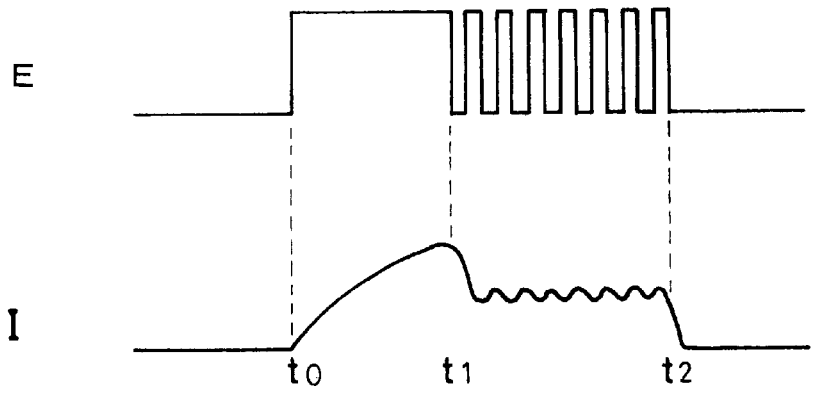
FIG. 6 is a waveform diagram of voltage and current signals applied to a coil.

FIG. 6 is a waveform diagram showing the relation between the current I and the applied voltage E on the coil 4. The high current supply period corresponding to the signal s1a lasts from t0 to t1 and the limited current supply period corresponding to the signal s1b extends from t1 to t2. As shown in FIG. 6, the coil current I is kept low according to the duty ratio of the voltage E in the controlled current supply period. The consumption power which largely affect heating on the coil and thermal capacitance of the transistor is a product of the current I and the voltage E. With a low current in the limited current supply period, the power is lowered to prevent excessive heating, thus allowing the transistor Tr3 to be facilitated in a scheme for radiation of heat.

What is claimed is:

1. A fuel injection valve controller apparatus for driving to open a fuel injection valve of an internal combustion engine by supplying an electromagnetic coil with a current, comprising:

a current detecting means for detecting the current flowing through the electromagnetic coil;

a current change detecting means for detecting decrease of the current on the basis of an output of the current detecting means during opening of the fuel injection valve in order to discriminate that the fuel injection valve is fully opened; and a current decreasing change emphasizing means, provided between an output terminal of the current detecting means and an input terminal of the current change detecting means, for emphasizing a decreasing change in the output signal of the current detecting means.

2. A fuel injection valve controller apparatus according to claim 1, wherein the current change detecting means comprises:

an operational amplifying means having a first input terminal connected to the output terminal of the current detecting means and a second input terminal connected to an output terminal thereof via a feedback path which includes a delay means; and a determining means for generating a current change detection signal through comparing between an output signal of the operational amplifying means and a reference setting.

3. A fuel injection valve controller apparatus according to claim 2, wherein said current decreasing change emphasizing means being provided between an output terminal of the current detecting means and a positive input terminal of the current change detecting means.

4. A fuel injection valve controller apparatus according to claim 2, wherein the delay means has a time constant set smaller for increase of the output of the current detecting means than for decrease of the same.

5. A fuel injection valve controller apparatus according to claim 2, wherein the feedback path from the operational amplifying means has a potential difference generating means for producing a predetermined potential difference when the output of the current detecting means is in increase.

6. A fuel injection valve controller apparatus according to claim 5, wherein the potential difference generating means is at least one of a Zener diode or a diode.

7. A fuel injection valve controller apparatus according to claim 1, wherein the current decreasing change emphasizing means comprises:

an operational amplifying means having a first input terminal connected to the output terminal of the current detecting means and a second input terminal connected to an output terminal thereof via a feedback path which includes a delay means; and a filter means connected to the output terminal of the operational amplifying means for removing a high frequency component from an output signal of the operational amplifying means, in which an output signal of the filter means is fed to the first input terminal of the current change detecting means.

8. A fuel injection valve controller apparatus according to claim 1, further comprising a current switching means for switching the current through the electromagnetic coil between a high current and a low current, in which the coil current is switched from the high current to the low current upon receipt of the detection signal of the current change detecting means.

9. A fuel injection valve controller apparatus according to claim 8, further comprising a delay means for delaying a detection signal of the current change detecting means by a predetermined length of time and providing it to the current switching means.

10. A fuel injection valve controller apparatus according to claim 8, wherein the high current is large enough to complete the valve opening motion within the predetermined length of time and the low current is as small as possible but enough to keep the fuel injection valve open which has been opened.

* * * * *

UNITED STATES PATENT AND TRADEMARK OFFICE

CERTIFICATE OF CORRECTION

PATENT NO. : 6,102,008

DATED : August 15, 2000

INVENTOR(S) : Susumu MAEDA et al.

It is certified that error appears in the above-identified patent and that said Letters Patent is hereby corrected as shown below:

Title page,

Item[73], delete "Honda Giken Kogyo Kabushiki Kaisha, Tokyo, Japan" and insert --HONDA GIKEN KOGYO KABUSHIKI KAISHA AND KEIHIN CORPORATION, BOTH OF TOKYO, JAPAN.--

Signed and Sealed this

Sixteenth Day of January, 2001

*Attest:*

*Attesting Officer*

Q. TODD DICKINSON

*Commissioner of Patents and Trademarks*